United States Patent [19]

Ruff

[11] 4,178,789

[45] Dec. 18, 1979

[54] SIMULTANEOUS PLUG-MILL ROLLING FOR INCREASED PRODUCTION AND ENHANCED TUBE QUALITY

[75] Inventor: James W. Ruff, Westlake, Ohio

[73] Assignee: United States Steel Corporation, Pittsburgh, Pa.

[21] Appl. No.: 910,973

[22] Filed: May 30, 1978

[51] Int. Cl.[2] ..... B21B 7/12

[52] U.S. Cl. ..... 72/209; 72/222

[58] Field of Search ..... 72/209, 222, 221, 97

[56] References Cited

U.S. PATENT DOCUMENTS

| | | | |
|---|---|---|---|
| 529,910 | 11/1894 | Horovsky | 72/222 |
| 741,702 | 10/1903 | Offutt | 72/222 X |
| 1,040,812 | 10/1912 | Stuting | 72/209 |
| 1,453,203 | 4/1923 | Stiefel | 72/209 |

*Primary Examiner*—Milton S. Mehr
*Attorney, Agent, or Firm*—Arthur J. Greif

[57] ABSTRACT

A pierced billet is fed through a plug rolling mill, equipped with a plurality of grooves. Initial rolling is effected in conventional manner, i.e. the shell is (i) rammed over a forming plug mounted on the front end of a mandrel, (ii) drawn over the plug by the work rolls, (iii) removed from the mandrel and (iv) returned to the entering side of the mill. Rather than effecting a second pass on the shell in the same roll groove, the shell is transferred to an adjacent receiving trough, aligned with a second groove of the same work roll. A second shell is then placed on the trough aligned with the first roll groove, thereafter the first shell is given a second pass in conjunction with the first pass of the next shell. Because of the use of more than one groove for subsequent passes, each roll pass can be contoured to suit the reduction desired. Thus, use of a second groove for the second pass permits a reduction in the roll flare employed, such that a significantly rounder tube can be delivered in the finish pass.

6 Claims, 7 Drawing Figures

Figure 1:
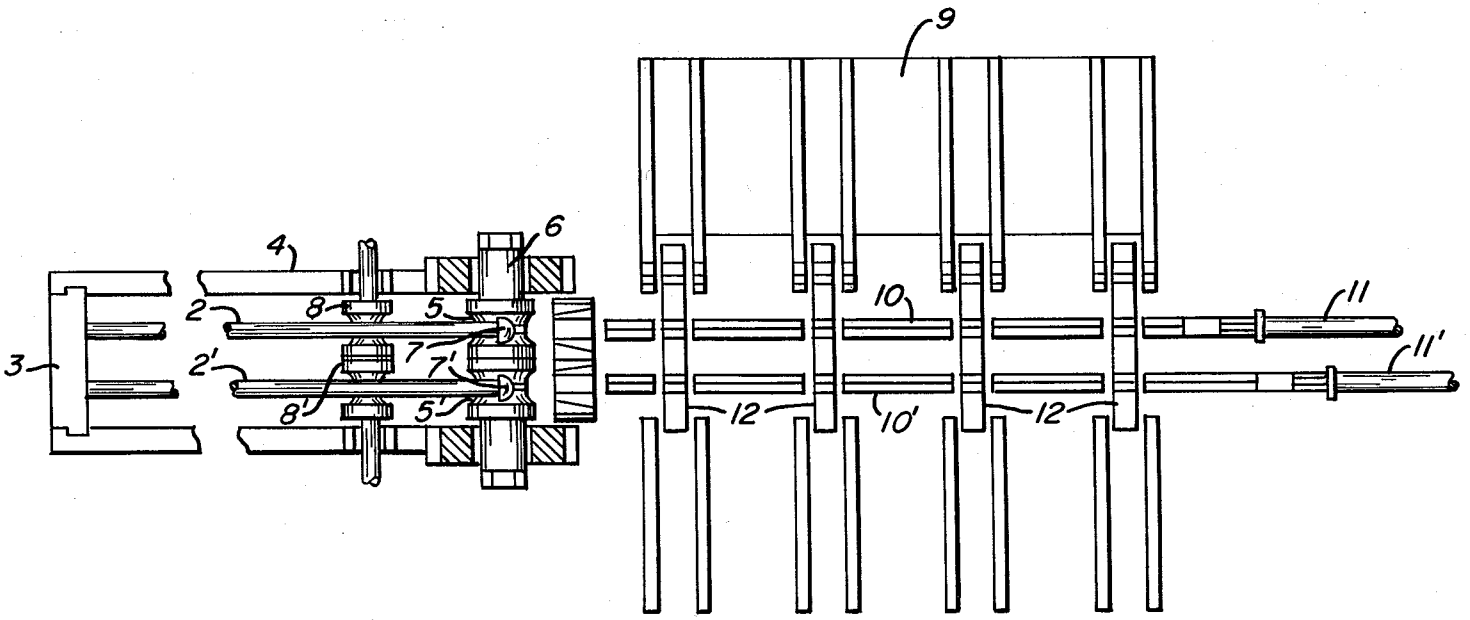
Figure 2A:
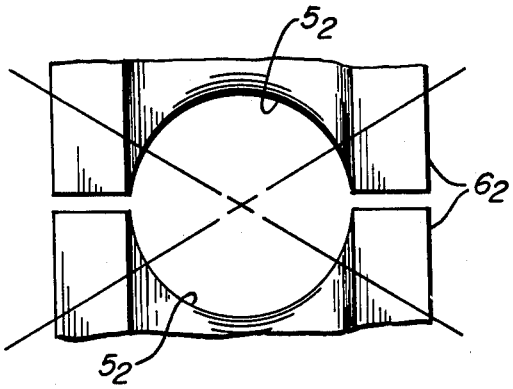
Figure 2B:
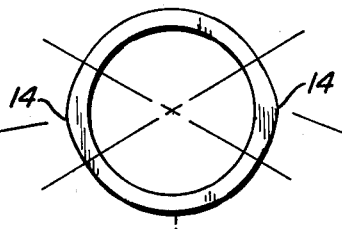
Figure 2C:
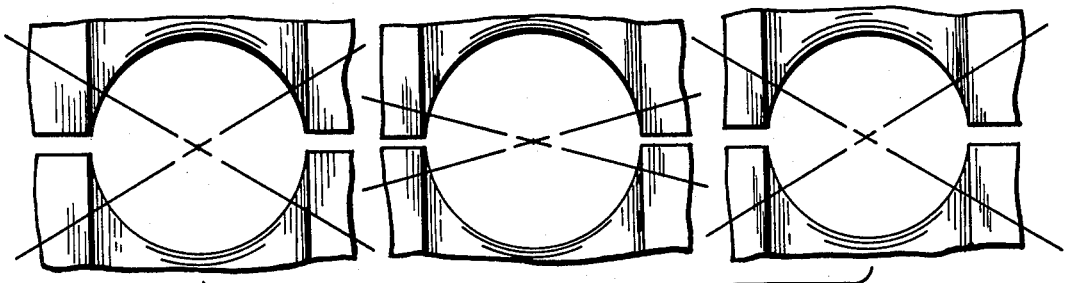
Figure 2D:
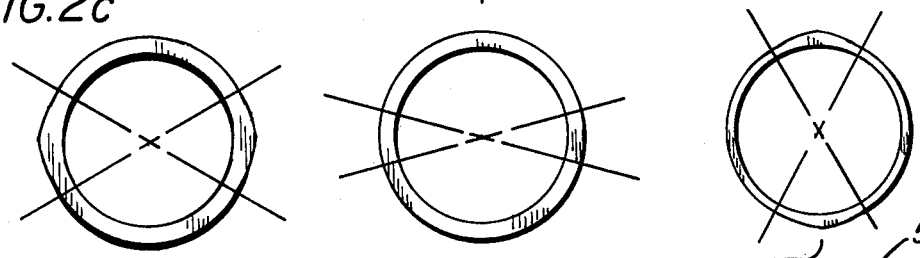
Figure 2E:
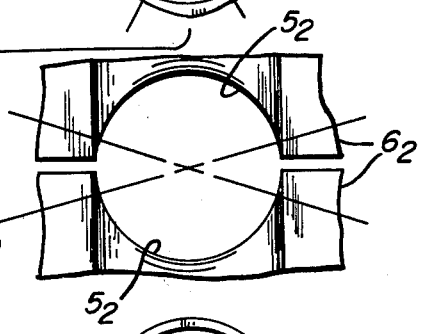
Figure 2F:
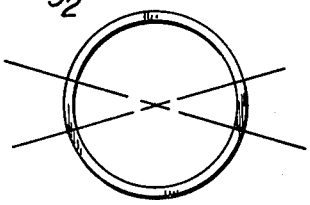

SIMULTANEOUS PLUG-MILL ROLLING FOR INCREASED PRODUCTION AND ENHANCED TUBE QUALITY

In the production of seamless tubing, plug rolling mills are employed for rolling pierced billets (also referred to as "shells") which are fed to the plug mill at a temperature of the order of 1700° to 1900° F. On its entry side, a conventional mill is equipped with a trough for receiving pierced billet and a pusher or ram capable of shoving the billet onto the plug with considerable force. On the delivery side of the rolls is a stationary guide table and a water cooled mandrel bar anchored at the rear of the table. This mandrel bar carries a removable plug, which during rolling of the shell is situated approximately within the roll mill grove. With the pierced shell lying in the feed trough, the ram forces the shell over the plug, and the shell is then rapidly drawn over the plug by the friction of the revolving rolls. This pulling action over the plug slightly reduces the wall thickness of the shell while increasing the length. Once the shell has completely passed through the roll groove, the plug is removed from the mandrel and the direction of the shell reversed so as to return it to the entering side of the mill. In conventional practice, another plug is then placed on the mandrel and the tube rotated through an angle of 90°, whereby, for a given shell only one groove is used to provide two passes through the same roll stand. The ram thus pushes the shell through the same groove for a second pass. When the pierced tube has completed its second pass, it is again returned to the entering side of the mill from which it is discharged for further fabrication through a reeling operation, the function of which is to round up and burnish the inside and outside surfaces of the tube.

In the production of seamless tubing, it is the plug mill operation which is generally the "rate controlling" or slowest step in the total operation. A further disadvantage of the above "conventional" procedure results from the use of the same groove for two passes, which creates significant limitations on both the quality (roundness, surface scratches) and the final length of tube that can be rolled. The instant process overcomes these disadvantages by permitting (a) up to an almost 50% reduction in time of the operating cycle and the achievement of tubes with greater elongation ratios and enhanced quality. This is achieved, in the instant invention, by laterally transferring the shell after completion of the first pass to a second, preferably adjacent receiving trough, whereby the shell is then rolled in a different groove of the same work rolls. In conjunction with this lateral transfer, another pierced billet is moved into position on the first receiving trough. Thereafter, both shells are simultaneously fed through their respectively aligned grooves for receiving a rolling pass, whereby the first shell is given a second rolling pass. As a result of the use of more than one groove, the second pass can better be contoured to suit the desired reduction.

The objects and advantages noted above, as well as other advantages of the instant invention, will become more apparent from a reading of the following description when taken in conjunction with the appended claims and the following drawings in which:

FIG. 1 is a representational drawing indicating how a conventional plug-rolling mill may be modified to effect the instant process and FIGS. 2 (*a*) through (*f*) provide a comparison of three processing routes (I) the conventional route in which a tube given two passes in the same roll groove and (II) one inventive embodiment—in which the second pass on a similar tube is performed in a different groove of somewhat less relief, and (II) a further inventive embodiment—in which an intermediate groove of smaller diameter is employed to provide greater tube elongations.

Referring to FIG. 1, water-cooled mandrel bars 2 and 2' are anchored in support 3 at the rear of stationary guide table 4. Each mandrel bar projects through a series of guides (not shown—generally of the double-bell type mounted on cross beams) lined up, one behind the other, directly in back of the grooves 5 and 5' machined in main or work rolls 6. The terminus of each mandrel bar is fitted respectively with plugs 7 and 7', each having an outer diameter somewhat larger than that of its respective mandrel bar, so as to provide clearance between the inside of the shell and the mandrel. Stripper rolls 8 and 8' located at the rear of the work rolls, rotate in a direction opposite to that of the main rolls and function only when the top main roll is in "open pass" or elevated position. Inlet table 9 feeds the heated pierced billet to first receiving trough 10. Located behind this trough and aligned therewith is ram 11 which serves to shove the shell over the corresponding plug 7 to permit the rolls to secure a good bite upon the shell. So started, the friction exerted by the revolving work rolls is sufficient to draw the shell rapidly over the plug, slightly reducing its diameter and wall thickness and increasing its length. After the work rolls have gripped the shell, ram 11 retracts to its inactive position (i.e. corresponding to that of ram 11', as shown in this figure). Once the shell has passed through the groove, plug 7 is removed, preferably by mechanical removal means well known to the art, the top work roll is elevated to the "open pass" position and stripper rolls 8 are then elevated so as to raise the tube to clear the bottom work roll and grip the tube to return it to the entry side of the mill.

If the conventional procedure were to be employed, another plug would then be placed on mandrel 2 and the same shell rotated through an angle of approximately 90° so as to be in position for a second plug rolling operation through the same groove 5. However, the instant invention, departs from this conventional procedure at this juncture. Rather than merely rotating the shell 90°, transfer means 12, e.g. of the walking-beam type as illustrated, transfers the first, once rolled shell to adjacent receiving trough 10'. In conjunction with this transfer, a second shell is fed from inlet table 9 to first receiving trough 10. Thereafter, rams 11 and 11' are simultaneously activated to push the shells onto forming plugs 7 and 7' respectively, in order that both shells may simultaneously be rolled. Subsequent to rolling, plugs 7 and 7' are removed and both shells then returned to entry side of the mill. The twice-rolled shell may then be discharged for further fabrication, generally through a reeling machine. It is seen, in utilizing two roll passes that the operating cycle may be reduced approximately to half of the normal time period. Nevertheless, it will readily be apparent that the instant invention is not limited to the use of two roll passes, as described above. Thus, the roll could be fitted with three grooves (not shown) or significantly more grooves, in order that, for example, five or even more such roll passes could be effected on one shell. The actual number of passes is only limited, to a practical extent, by the power availability, mill width, and temperature loss between each pass.

The desirability of employing (a) different roll groove contours for passes subsequent to the first, and/or (b) more than two roll passes, will better be understood by referring to FIG. 2. Work rolls $6_2$ have semicircular grooves $5_2$ machined in their surface. Viewed from the entry side of the rolls, the opening formed by the groove is not a true circle, but is slightly elliptical with the major axis lying in a horizontal plane. This elliptical flare of the groove is provided to prevent the edge thereof from shearing the workpiece. As a result of this flare, after completion of the first pass the shell will exhibit longitudinal bulges 14 (overemphasized in FIG. 2). These bulges are then partially eliminated by rotating the shell 90° in order that the entire surface receives a somewhat similar treatment in the elliptical groove. Nevertheless, if the conventional procedure (Route I) were to be employed in which the rotated shell is again passed through the same roll groove I(c), the resultant product would still have a distinctly out-of-round shape as shown in I(d). The instant invention, which of necessity requires that the shell be rolled in successively different roll grooves, permits the use of different roll pass contours, while utilizing a basically conventional plug mill arrangement. As an example, FIG. 2 (Route II) depicts the use of a second groove contour of lesser relief. This is permissible from the fact that the major portion of the area reduction has been accomplished in the first groove, thus the relief and clearances required for the first groove are not required in a second groove and the second groove can therefore be made tighter II(c) providing a rounder and more uniform wall tube II(d). It will also be evident, in addition to the enhanced roundness and wall achieved by utilizing a final groove of less relief and clearance, that an additional intermediate groove(s) could be employed, as shown by Route III. In advancing from the first groove (a) via Route III, the second groove III(c) can be made somewhat smaller in diameter, accomplishing an area reduction approximately the equivalent of the first groove, thereby providing a very significant increase in total elongation. Ultimately, the shell reaches the final groove III(e) contoured similarly to that of the second groove in Route II, thus delivering a rounder more uniform wall shell, III(f). Additionally, the instant process permits the design of a mill with further flexibility, since there is no longer a need to utilize a roll material which is a compromise between that which would be optimal for both the first and second roll pass. Thus, the finish on the exterior shell surface can further be enhanced by a mill design incorporating roll rings, instead of an integral roll and shaft arrangement. Thereby the best roll material for a given pass can be employed to ensure optimum wearability and exterior surface finish for a particular roll pass.

I claim:

1. In the production of seamless tubing, wherein shells are transferred to a plug rolling mill to receive a rolling operation consisting of at least two plug-rollng passes, each of said rolling passes consisting of pushing the shell over a plug attached to a supported mandrel bar, said plug lying within a first roll groove of the work rolls of said rolling mill, drawing said shell over the plug by the rolling friction of the roll groove, removing the plug and reversing the travel of the shell so as to strip it from the plug, thereafter repeating the rolling procedure for at least one additional pass in the same roll groove, the improvement for significantly increasing the production rate of said plug rolling operation, which comprises, (a) after completion of the first pass, and without removal of the mandrel bar from its support, laterally transferring the first shell to position for effecting the second pass in a second roll groove of the same roll, (b) moving a second shell into position for effecting a first pass thereon in said first roll groove, and (c) simultaneously pushing said second shell and said first shell through said first and second roll grooves, respectively.

2. The method of claim 1, wherein after the first roll pass said first shell is rotated 90° prior to step (c).

3. The method of claim 2, wherein the relief and clearance of said second roll groove is less than that of said first roll groove, so as to produce a shell with more uniform wall thickness and with enhanced roundness.

4. The method of claim 1, in which said first shell is given at least three rolling passes, which comprises (d) after completion of step (c), and without removal of the mandrel bar from its support, laterally transferring the first shell to position for effecting a third pass in a third roll groove of the same roll, (e) moving said second shell into position for effecting a second pass thereon, in said second roll groove, (f) moving a third shell into position for effecting a first pass thereon in said first roll groove, and (g) simultaneously pushing said third, second and first shells through said first, second and third roll grooves, respectively.

5. The method of claim 4, wherein after the first roll pass, said first shell is rotated by an angle of 90°, at least once prior to the last rolling pass it receives.

6. The method of claim 5, in which said first shell is given three rolling passes, wherein (i) said second roll groove has a diameter smaller and (ii) said third roll groove is provided with less relief and clearance, than said first roll groove.

* * * * *